US008739897B2

(12) United States Patent
Thorp et al.

(10) Patent No.: US 8,739,897 B2
(45) Date of Patent: Jun. 3, 2014

(54) PRESSURE COMPENSATION AND ROTARY SEAL SYSTEM FOR MEASUREMENT WHILE DRILLING INSTRUMENTATION

(75) Inventors: Richard E. Thorp, Shanghai (CN); Raju M. Eason, Stafford, TX (US); Charles Borsos, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1035 days.

(21) Appl. No.: 11/945,542

(22) Filed: Nov. 27, 2007

(65) Prior Publication Data

US 2009/0133930 A1 May 28, 2009

(51) Int. Cl.
*E21B 12/00* (2006.01)

(52) U.S. Cl.
USPC ..... 175/25; 175/320

(58) Field of Classification Search
USPC ..... 175/57, 25, 107, 104, 320
See application file for complete search history.

(56) References Cited

U.S. PATENT DOCUMENTS

| | | | | |
|---|---|---|---|---|
| 2,974,982 | A | 3/1961 | Luenberger | |
| 3,397,894 | A | 8/1968 | Mastriforte et al. | |
| 5,517,464 | A * | 5/1996 | Lerner et al. | 367/84 |
| 6,016,288 | A * | 1/2000 | Frith | 367/85 |
| 6,837,315 | B2 * | 1/2005 | Pisoni et al. | 175/61 |
| 7,083,008 | B2 | 8/2006 | Thorp et al. | |
| 7,178,608 | B2 * | 2/2007 | Mayes et al. | 175/48 |
| 7,201,239 | B1 * | 4/2007 | Perry | 175/104 |
| 7,810,582 | B2 * | 10/2010 | Webb | 175/55 |
| 2005/0016771 | A1 * | 1/2005 | Mayes et al. | 175/48 |
| 2005/0194186 | A1 * | 9/2005 | Thorp et al. | 175/57 |
| 2005/0231383 | A1 * | 10/2005 | Pratt et al. | 340/855.4 |

* cited by examiner

*Primary Examiner* — Jennifer H Gay
*Assistant Examiner* — Elizabeth Gitlin
(74) *Attorney, Agent, or Firm* — Chadwick A. Sullivan; Brigitte Echols

(57) ABSTRACT

A pressure compensation system for a wellbore instrument coupled to a drill string includes a shaft rotatably mounted with respect to an instrument housing. A lubrication chamber included in the instrument has at least one bearing for rotatably supporting the shaft. The lubrication chamber includes a face seal coupled on one face to the shaft and on another face to the housing. A pressure compensator establishes hydraulic communication between the lubrication chamber and the interior of the drill string. The compensator includes a barrier to fluid movement between the lubrication chamber and the interior of the drill string. The barrier enables pressure communication therebetween. The compensator includes a pressure communication port extending between the barrier and a portion of the shaft exposed to the interior of the drill string.

23 Claims, 5 Drawing Sheets

PRESSURE COMPENSATION AND ROTARY SEAL SYSTEM FOR MEASUREMENT WHILE DRILLING INSTRUMENTATION

BACKGROUND OF THE INVENTION

1. Field of the Invention

The invention relates generally to the field of measurement while drilling ("MWD") instrumentation. More particularly, the invention relates to structures for providing wellbore hydrostatic pressure compensation and fluid sealing for rotating shafts in a wellbore instrument coupled to a drill string.

2. Background Art

MWD instruments are used for, among other purposes, measuring the trajectory of wellbores drilled through the Earth's subsurface. A typical MWD instrument is configured to be coupled in the lower portion of a drill string used to drill the subsurface formations, and includes geodetic trajectory sensing devices, called "directional sensors" that measure one or more parameters related to the geodetic orientation of the MWD instrument. Geodetic orientation of the MWD instrument can be used to determine geodetic trajectory of the wellbore at the longitudinal position of the MWD instrument. Typical MWD instruments also include one or more forms of signal telemetry so that the measurements made by the directional sensors can be transmitted to control units at the Earth's surface. The measurements may be used at the surface to enable the wellbore operator to change the trajectory as desired.

One type of telemetry known in the art is referred to as a "mud siren" and which includes a rotating shaft driven by a motor in the instrument. The shaft rotates a rotor having a selected pattern of one or more flow orifices therein. The rotor is disposed proximate a stator, which itself includes one or more orifices or features that cooperate with the orifice(s) on the rotor. The rotor and stator are disposed inside the drill string so as to affect the flow of drilling fluid through the drill string in a certain manner. By suitable rotation of the motor, and thus the shaft and rotor, flow of drilling mud through the interior of the drill string can be modulated to communicate the signals from the directional sensor to the Earth's surface. Such telemetry is referred to as "mud pulse" telemetry.

It is necessary for operation of the shaft for at least part of the shaft to be enclosed in a substantially sealed chamber. The chamber is typically filled with bit or other electrically non-conductive, lubricating and particle free liquid to as to protect bearings that rotatably support the shaft from intrusion of drilling mud. It is also necessary to provide a seal around the shaft that enables rotation thereof while excluding mud from bypassing the seal. A typical seal element is called a "face seal" and consists of a planar surface coupled to the shaft and a corresponding surface coupled to the housing that supports the shaft placed proximate each other. The surfaces are typically ceramic, tungsten carbide or similar wear resistant material. A reservoir of fluid (typically oil) is disposed in the MWD instrument and is maintained at a selected pressure referenced to the external hydrostatic pressure of the drilling mud. It is preferable that the reservoir pressure is maintained at least as high as, and preferably slightly higher than the external hydrostatic pressure such that a small leakage is created across the shaft seal. Such leakage may clean the seal, lubricate the seal and prevent accumulation of particulate matter from the drilling mud from accumulating on the seal surfaces, thus reducing the chance of seal damage. In some MWD instruments known in the art, the length of the shaft results in the shaft having significant flexibility. Therefore, in such instruments, the seal is typically articulated using an elastomer ring so that any bending of the shaft does not result in excessive clearances between the seal surfaces.

In order to maintain the appropriate pressure in the oil reservoir as the instrument traverses the wellbore and is exposed to a wide range of external hydrostatic pressure in the drilling mud, which increases linearly with vertical depth of the wellbore, typically MWD instruments include a pressure compensator that causes the reservoir to be exposed to mud pressure in the drill string while excluding mud from entering the reservoir. Pressure compensators are typically either an elastomer bladder filled with oil, externally subjected to drill string fluid and internally coupled to the reservoir (or forming the reservoir) or a piston that is exposed to drill string fluid in one side and is in hydraulic communication with the reservoir on the other side. A suitable hydrostatic pressure reference position is carefully selected for the pressure compensator because there is significant fluid pressure drop through the MWD instrument. If a pressure reference is selected that is subject to substantial pressure drop, the reservoir pressure may be inadequate for proper seal operation and may result in mud intrusion into the reservoir and hydraulic system. Further, inadequate pressure compensation may enable mud intrusion across the shaft seal. Proper compensation is also important because of short duration mud pressure increases caused by the telemetry modulation of mud pressure.

There continues to be a need for improved pressure compensation and shaft sealing for MWD instruments.

SUMMARY OF THE INVENTION

One aspect of the invention is a pressure compensation system for a wellbore instrument coupled to a drill string. The instrument includes a shaft rotatably mounted with respect to an instrument housing. A lubrication chamber included in the instrument has at least one bearing for rotatably supporting the shaft. The lubrication chamber includes a face seal coupled on one face to the shaft and on another face to the housing. A pressure compensator establishes hydraulic communication between the lubrication chamber and the interior of the drill string. The compensator includes a barrier to fluid movement between the lubrication chamber and the interior of the drill string. The barrier enables pressure communication therebetween. The compensator includes a pressure communication port extending between the barrier and a portion of the shaft exposed to the interior of the drill string.

A wellbore instrument according to another aspect of the invention includes a housing configured to be coupled to a drill string, a shaft rotatably mounted with respect to the housing, a lubrication chamber disposed in an annular space between the shaft and the housing, a pressure compensator in hydraulic communication with an interior of the drill string and the lubrication chamber, the pressure compensator configured to maintain a fluid pressure in the lubrication chamber at a fluid pressure inside the drill string proximate the instrument. A face seal is configured to seal a space between the shaft and the housing. One face of the face seal is coupled to the shaft. The other face of the face seal is functionally coupled to the housing. At least one of the housing face and the shaft face includes a metal bellows coupled between the respective one of the housing face and the housing and the shaft face and the shaft.

Another aspect of the invention is a method for pressure compensating a wellbore instrument coupled to a drill string. The instrument includes a shaft rotatably mounted with respect to a housing. The housing is configured to couple to the drill string. An annular space between the housing and the drill string includes a lubrication chamber. The method includes establishing hydraulic communication between an interior of the lubrication chamber and an interior of the drill string through a port in the shaft, and preventing movement of fluid between the interior of the drill string and the lubrication chamber.

Other aspects and advantages of the invention will be apparent from the following description and the appended claims.

DETAILED DESCRIPTION

Figure 1A:
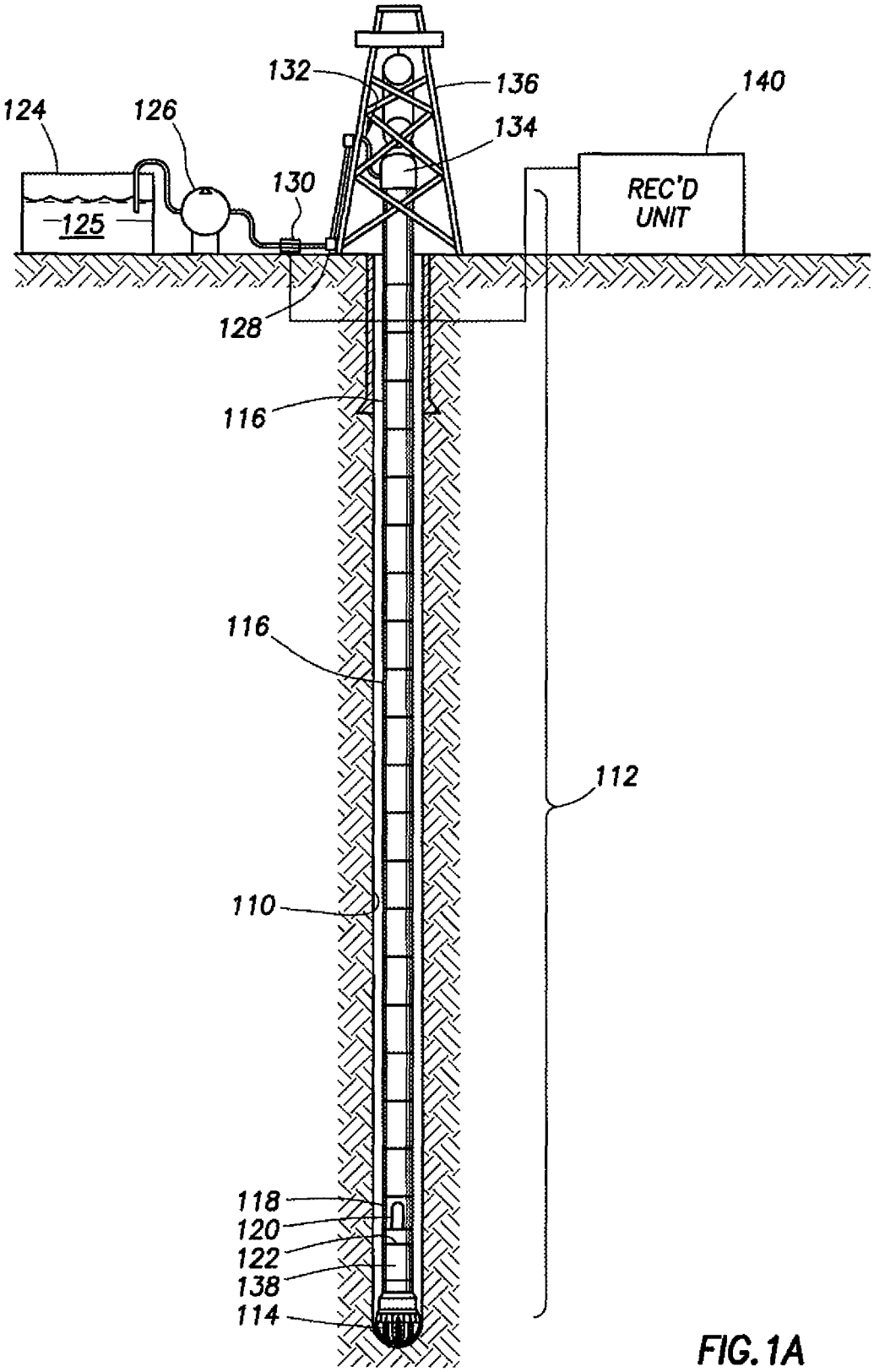
FIG. 1A shows one example of a drilling system including an MWD instrument as ordinarily used in drilling a wellbore.

FIG. 1A shows an example of MWD instrument 120 as it is ordinarily used in drilling operations. A drilling rig 136 or similar structure disposed at the Earth's surface includes hoisting devices (not shown separately) to suspend a drill string 112 in a wellbore 110 drilled through the Earth's subsurface. The drill string 112 may be made of a plurality of pipe segments ("joints") 116 threadedly coupled end to end. A lower end of the drill string 112 may include a drill bit 114 of any type known in the art. The drill bit 114 increases the length of the wellbore 110 when it is rotated and axially urged into the formations in the subsurface. In certain types of drilling operations, particularly in "directional drilling" operations where an MWD instrument is used, the bit may be rotated by an hydraulically powered motor 138 known as a "steerable motor." Such motors include a device that converts flow of drilling fluid (shown at 125 in tank 124) through the interior of the drill string 112 into rotational energy to operate the drill bit 114. Such motors may also have a small bend along the longitudinal dimension of the motor housing to enable changing the trajectory of the wellbore 110 as is known in the art. In addition, the drill string 112 may be rotated by a top drive 134 or similar device suspending in the drilling rig 136.

During drilling operations, one or more pumps 136 lift drilling fluid ("mud") 125 from a tank 124 or pit or similar reservoir and discharge the mud through a standpipe 132, through the top drive 134 and into the interior of the drill string 112. The mud 125 flows downwardly through the drill string 112 until it reaches a drill collar 118 having the MWD instrument 120 seated in a muleshoe sub 122. The MWD instrument 120 in the present example can be of a type that is retrievable from the drill string by slickline, wireline, coiled tubing or similar device (none shown in FIG. 1A). The purpose of the muleshoe sub 122 is to provide a geometrically fixed seating position with known rotational orientation to the drill string 112 such that when seated therein, the rotary orientation of the MWD instrument 120 with respect to the drill string 112 is known. The MWD instrument 120 may include devices (to be explained further below with reference to FIG. 1B) that modulate the flow of drilling mud 125 such that signals may be transmitted through the drill string 112 by such modulation. The modulation signal may be detected using one or more pressure transducers 130, typically in the standpipe 128 or in the pump 126 discharge line. Pressure-relate signals generated by the one or more transducers 130 are conducted to a recording unit 140 which can include a suitable modulation signal detection system (not shown separately) to decode the signals transmitted by the MWD instrument 120.

As is known in the art, the drilling mud 125 also serves to cool and lubricate the drill bit 114, and lifts drill cuttings to the Earth's surface. After the mud 125 is returned to the surface, the cuttings are removed and the mud 125 is returned to the tank 124 for reuse. As the mud 125 moves through the drill string 112, it is subject to pressure drop caused by dynamic fluid interaction with the various components of the drill string 112, including the MWD instrument 120, the motor 138 and the drill bit 114. Thus, the pressure in the mud 125 at any point along the interior of the drill string is the sum of the hydrostatic pressure (the pressure exerted in the absence of flow), and the pump pressure, less the pressure losses caused by the foregoing fluid dynamics. The hydrostatic pressure is proportional to the density of the mud 125 and the vertical depth at which the pressure is to be determined.

The MWD instrument 120 includes an internal hydraulic system (explained below with reference to FIGS. 1B, 4A and 4B) that enables certain components of the MWD system 120 to rotate with respect to the instrument housing, while excluding the mud 125 from entering the MWD instrument housing. Such hydraulic systems are preferably internally pressurized to substantially the same pressure as that existing inside the drill string so that sealing elements in the MWD instrument 120 will not be subjected to excessive pressure differential between the pressure in the drill string 112 and the pressure in the hydraulic system. Typically, the moving parts of the MWD instrument 120 that require such sealing are associated with the telemetry modulator, the function of which is described above. Rotation of the certain components may be selected to cause any one of a number of different modulation types, including "positive pulse" wherein a momentary mud pressure increase is intended to correspond to a digital bit of information, "negative pulse" wherein a momentary decrease in mud pressure is intended to correspond to information, and continuous wave or "mud siren" which may use modulation techniques such as phase shift keying. The type of modulation is not intended to limit the scope of the invention. While the present example is directed to MWD instrumentation, it should be clearly understood that other "while drilling" instruments known in the art as "logging while drilling" (LWD) instruments are also within the scope of this invention. LWD instruments are ordinarily distinguished from MWD instruments by the types of sensors disposed therein. MWD instruments typically include directional sensing elements to determine the geodetic trajectory of the wellbore, while LWD instruments typically include sensors that measure petrophysical properties of the formations penetrated by the wellbore. The invention is not limited in scope to any one or more types of sensors to be used while a wellbore is being drilled.

Figure 1B:
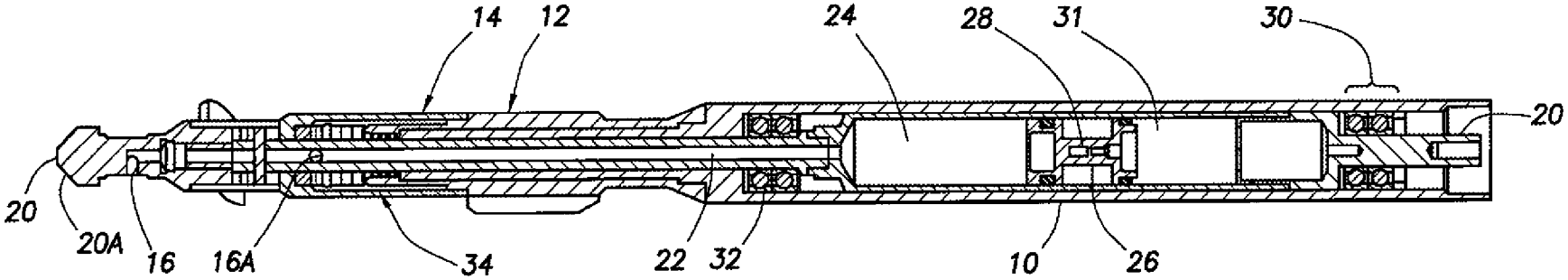
FIG. 1B shows a cut away view of one example of a modulator section of a measurement while drilling ("MWD") instrument according to one aspect of the invention.

One example of a telemetry modulator portion of the MWD instrument (120 in FIG. 1A) is shown in cut away view in FIG. 1B. The modulator portion includes a drive shaft 20 that is rotatably supported inside the instrument housing 10. The drive shaft 20 may be made from steel or other high strength metal, and preferably is made from non-magnetic allow such as monel, or an alloy sold under the trademark INCONEL, which is a registered trademark of Huntington Alloys Corporation, Huntington, W. Va. The drive shaft 20 may include a feature on its upper end called a spearpoint 20A that is configured to engage a device (not shown) moved through the interior of the drill string (112 in FIG. 1A) to remove the MWD instrument from the interior of the drill string (112 in FIG. 1A). The housing 10 may also be formed from non-magnetic high strength alloy and can include a modulator stator 12 disposed proximate its upper end. For purposes of the present description, "upper" and "lower" refer to the relative positions of the MWD instrument (120 in FIG. 1A) as it is disposed in the drill string (112 in FIG. 1A). The stator 12 includes features (not shown separately) that cooperate with corresponding features (not shown) on a modulator rotor 14. The rotor 14 is coupled to the drive shaft 20 such that drive shaft rotation is transferred directly to the rotor 14. Rotation of the rotor 14 causes the corresponding features (not shown) on the rotor 14 and stator 12 to change the cross section of a flow path for the drilling mud (125 in FIG. 1A) therethrough in a predetermined manner such that flow of the mud may be modulated to transmit signals from sensors (not shown in FIG. 1B) in the MWD instrument (120 in FIG. 1A) to the Earth's surface. Flow modulation results in momentary pressure increases in the pressure in the mud which are detected by the transducer (130 in FIG. 1A) at the surface. The amplitude of such pressure increases can be as much as several hundred pounds per square inch, depending on the mud flow rate, among other parameters. By communicating the mud pressure existing above the rotor 14 and stator 12 to a pressure compensator, explained further below, the compensator will always be charged to a pressure at least as high as the mud pressure on the outside of the face seal (explained below).

The drive shaft 20 can be rotatably supported inside the housing 10 by an upper bearing and seal assembly 34, a center bearing assembly 32 and a lower bearing and seal assembly 30. Annular space between the housing 10 and the drive shaft 20 may define a "lubrication chamber" disposed longitudinally between the upper bearing and seal assembly 34 and the lower bearing and seal assembly 30. Such lubrication chamber is filled with hydraulic fluid such as oil which lubricates the bearings in each of the upper 34 and lower 30 bearing and seal assemblies, and in the center bearing assembly 32. Below the lower bearing and seal assembly 30 and inside the housing 10 is a sealed chamber maintained at atmospheric pressure in which may be disposed various electronic components (not shown) that make measurements, among others, of the geodetic orientation of the MWD instrument that are to be communicated to the surface by the telemetry modulator. The drive shaft 20 may be coupled to a motor (not shown) disposed in such chamber in the housing 10, which causes the above described rotation of the drive shaft 20 for mud flow modulation. The general purpose of the lubrication chamber is to provide lubrication to the bearings that rotatably support the drive shaft 20 with respect to the housing 10 and to maintain a seal to exclude drilling mud from entering the atmospheric chamber inside the housing 10 while the drive shaft 20 rotates with respect to the housing 10.

It should be clearly understood that the present invention is not limited in scope to use with a driveshaft that turns a telemetry modulator. In other examples a drive shaft rotatably mounted with respect to an instrument housing may be coupled to a turbine or similar device that converts flow of the drilling mud (125 in FIG. 1) into rotational energy to drive an electric generator or alternator disposed in the instrument housing. In such examples, the structure purpose of the bearing and seal assemblies would be the same as in the present example: to enable rotation of the drive shaft in the drilling mud, while excluding drilling mud from entering the interior of the instrument housing wherein electronic devices are mounted and operated at surface atmospheric pressure.

The upper bearing and seal assembly 34 is exposed, externally to the housing 10, to the drilling mud under pressure. Such pressure, as explained above with reference to FIG. 1A, includes the hydrostatic pressure of the mud column extending from the Earth's surface to the vertical depth in the wellbore at which the MWD instrument is disposed, as well as pressure exerted by the mud pump (136 in FIG. 1A), less dynamic pressure losses. A seal portion of the upper bearing and seal assembly 34 preferably can be a ceramic or carbide face seal. One part of the face seal is affixed to the housing 10 while the other part of the face seal is affixed to the drive shaft 20. Such will be explained in more detail below with reference to FIG. 5. The faces on the seal are in close proximity with each other, separated only by a thin film of the hydraulic oil ultimately coming from within a reservoir 31 formed inside the drive shaft 20. As will be appreciated by those skilled in the art, the pressure in the reservoir 31 should be maintained at a selected amount above the maximum pressure of the mud inside the drill string at the position of the MWD instrument so that a small leakage of the oil may be maintained between the faces of the face seal. Such leakage lubricates the seal and prevents accumulation of contaminants from the mud on the faces of the seal.

As explained above with reference to FIG. 1A, the MWD instrument is exposed to a wide range of mud pressure inside the drill string. Compensation of the pressure in the reservoir 31 is thus necessary to obtain the desired hydraulic pressure with respect to the mud pressure. In the present example, a pressure compensator may be arranged to include, for example, a compensation pressure reference that is the highest expected pressure in the drilling mud proximate the MWD instrument so as to prevent mud intrusion through the face seal and into the reservoir 31. Alternatively, the compensation pressure reference may be at the pressure experienced by the face seal in the drilling mud. In the present example, such pressure compensator may include a pressure port in the upper end of the drive shaft 20. Such port may be disposed in or near the spearpoint 20A, as shown at 16, or, alternatively, may be disposed proximate the face seal, as shown at 16A. The pressure port (whether 16 or 16A) provides hydraulic communication between the mud proximate the upper end of the MWD instrument and a central conduit or passage 22 extending along inside the drive shaft 20. If the port is disposed in or near the spearpoint 20A, then the applied compensation pressure to the lubrication chamber will be maintained at the maximum mud pressure on any part of the MWD instrument. If the port 16A is disposed near the face seal, then the pressure applied to the lubrication chamber will be essentially the same as that experienced by the face seal in the drilling mud.

At the lower end of the passage 22, in an enclosed chamber inside the drive shaft 20, is a mud chamber 24. The mud chamber 24 is arranged to prevent fluid movement from the mud chamber 24 into a reservoir 31, which is also disposed in the enclosed chamber inside the drive shaft 20, but enables pressure communication therebetween. Pressure communication between the mud chamber 24 and the reservoir 31 is performed by a compensator piston 26 that sealingly and movably engages the interior wall of the enclosed chamber within the drive shaft 20. The compensator piston 26 is free to move longitudinally inside the enclosed chamber such that hydrostatic pressure in the mud chamber 24 is freely transferred to the reservoir 31. The compensator piston 26 may include a check valve 28 to enable escape of hydraulic oil in the reservoir 31 pressurized by thermal expansion. Thus, the fluid pressure existing in the drilling mud proximate the upper end of the MWD instrument at any time is communicated to the reservoir 31 by the hydraulic conduit including the port (16 or 16A), the passage 22, the mud chamber 24 and the compensator piston 26. The pressure in the reservoir 31 is thus at all times at least equal to the mud pressure at the position where the mud pressure is greater than that at any other position proximate the MWD instrument.

The reservoir 31 is in hydraulic communication with the interior portion (lubrication chamber) of the housing 10 defined between the upper 34 and lower 30 bearing and seal assemblies. Thus, the oil in the lubrication chamber portion of the housing 10 is maintained at all times at the highest mud pressure in the drill string existing proximate the MWD instrument. Thus, it is expected that under no circumstances will the pressure in the mud proximate the upper seal and bearing assembly 34 exceed the pressure in the reservoir 31 (and thus the lubrication chamber). The lower bearing and seal assembly 30 is exposed on one side to atmospheric pressure inside the housing 10, and sealing against mud infiltration is not a consideration in the seal design thereof.

Figure 2:
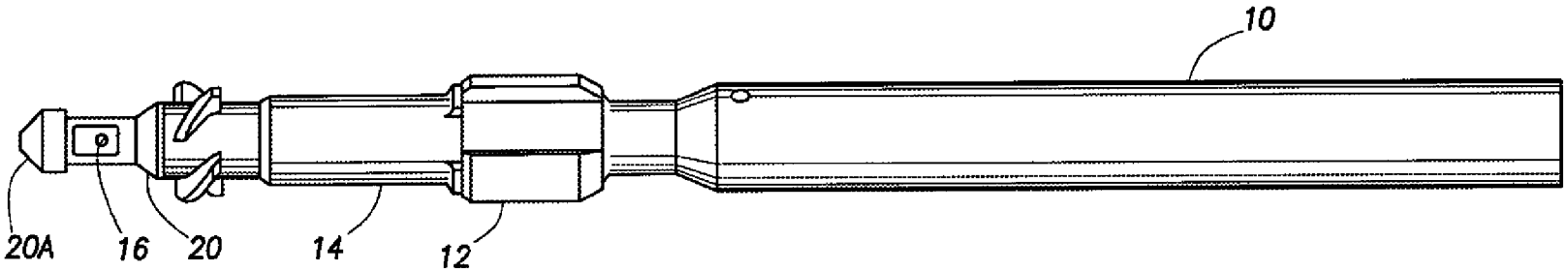
FIG. 2 shows an external view of the example shown in cut away view in FIG. 1B.

FIG. 2 shows an external view of the housing 10, stator 12, rotor 14 and driveshaft 20. The port 16 and spearpoint 20A are also shown in FIG. 2.

It should also be clearly understood that the invention is not limited in scope to so-called "probe" type MWD and/or LWD instrumentation. In the present example, the MWD instrument is disposed in a housing that is configured to traverse the interior of the drill string (112 in FIG. 1A) so that it is possible to remove the MWD instrument from the drill string with the drill string still disposed in the wellbore (110 in FIG. 1A). However, the principle of the invention is equally applicable to so called "collar based" MWD and/or LWD instruments, wherein the active components of the instrument are disposed in a heavy weight, thick walled segment of the drill string called a "drill collar."

Figure 3:
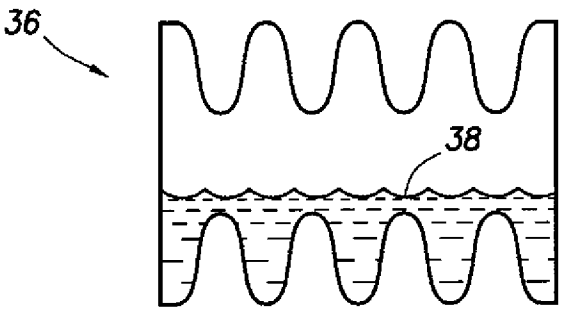
FIG. 3 shows one example of a freeze protection device that may be used in various examples of MWD instrument pressure compensator.

In some circumstances, it is possible for the mud in the mud chamber (24 in FIG. 1B) to freeze. In one example, to prevent damage to the compensation system, a freeze protection device may be included in or disposed in the mud chamber (24 in FIG. 1B). FIG. 3 shows one example of such freeze protection device. The freeze protection device may include a metal bellows 36 that is at least partially filled with relatively incompressible liquid 38. The bellows 36 is preferably designed to resist crushing at the highest expected fluid pressure in the mud chamber. In the event the mud in the mud chamber becomes partially or totally frozen, the bellows 36 may crush to absorb the expansion caused by such freezing. Damage to the pressure compensation system may thus be prevented.

Figure 4A:
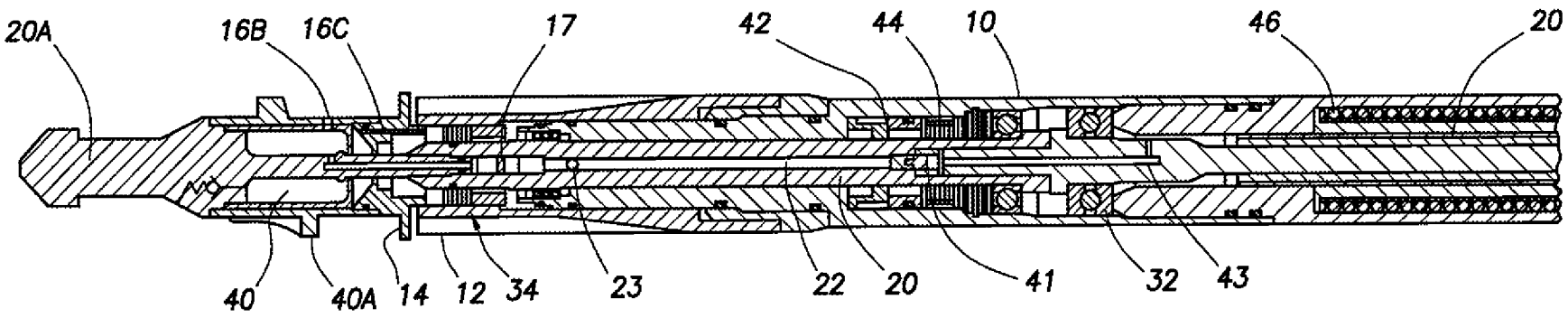
FIGS. 4A and 4B show a different example of pressure compensation in a MWD instrument.
Figure 4B:
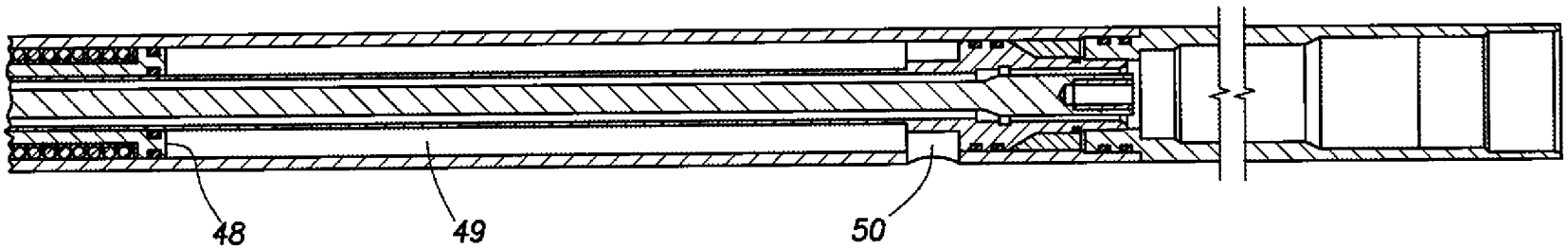

Another example of a pressure compensation system is shown in cut away view in FIGS. 4A and 4B. Referring first to FIG. 4A, the upper portion of the drive shaft 20 may include a removable enclosure 40A. The enclosure 40A may be removed from the drive shaft 20 when the drive shaft 20 is disassembled from the housing 10, such as during repair and maintenance procedures. In one example, the drive shaft 20 may be longitudinally separable, such that access to the enclosure 40A may be obtained without removing the entire drive shaft 20 from the housing 10.

The enclosure 40A may define therein an interior chamber that may be filled with an elastomer bladder 40. The bladder 40 may be in hydraulic communication on its exterior with mud pressure inside the drill string through a port 16B formed through the wall of the enclosure 40A. An interior of the bladder 40 may be hydraulically connected to the passage 22 inside the drive shaft 20. Thus, mud pressure at the position of the highest pressure is communicated to the interior of the drive shaft 20 as in the previous example, the difference being that the oil reservoir extends into the upper end of the drive shaft 20. The bladder 40 may store a sufficient quantity of oil such that the leakage expected to occur during drilling between one or more "connections" (drilling operations where the mud pumps are stopped and a segment of pipe is added to or removed from the drill string) is at most smaller than the capacity of the bladder 40. During a connection, the mud pressure outside the bladder 40 drops to the hydrostatic pressure of the mud column, and a bladder recharge system at slightly higher oil pressure, to be further explained below, recharges the bladder 40 with oil. Drilling operations may then safely resume. An interior passage 22 in the drive shaft 20 may include therein a check valve (e.g., a reverse biased check valve) 41. The interior passage 22 in the drive shaft 20 may also include therein a Schrader or similar check valve 17 such that an upper portion of the drive shaft 20 may be removed when such oil recharge system is pressurized. The Schrader valve 17 will close upon disconnection of the upper portion of the drive shaft 20 such that pressure in the recharge system is retained. A port 23 from the interior of the passage 22 to an interior chamber within the housing 10 may be formed as shown in FIG. 4A. The interior chamber inside the housing 10 serves essentially the same purpose as the chamber defined between the upper and lower bearing and seal assemblies described with reference to FIG. 1B, that is, to maintain oil lubrication on the bearings 34, 32, 30 and to exclude entry of mud inside the housing 10.

In the present example, the pressure compensator may include a thermal expansion compensator piston 42 disposed proximate the center bearing 32 inside the housing 10 and outside the drive shaft 20. The thermal compensator piston 42 may be biased by a spring 44 or similar device and may sealingly engage the exterior of the drive shaft 10 so as to be able to exert or relieve pressure on the oil in the pressure compensation system.

The oil refill system includes a recharge reservoir piston (48 in FIG. 4B) disposed in the annular space between the housing 10 and the drive shaft. The recharge reservoir piston 48 is biased by a spring 46 so as to maintain a pressure in the oil disposed in the recharge reservoir (49 in FIG. 4B) at a selected pressure above the oil pressure in the bladder 40. During connections, when the pressure in the bladder 40 returns to the hydrostatic pressure in the mud column, a slightly higher pressure in the recharge reservoir (49 in FIG. 4B) will exist. Oil in the recharge reservoir 49 will then flow through feed 43 to the passage 22 in the drive shaft 20 to charge the bladder 40 to the higher pressure in the refill reservoir 49. The foregoing will refill the bladder with oil during connections. A port 50 to the exterior of the housing 10 may provide compensation when oil is lost from the recharge reservoir 49 during connections.

Figure 5:
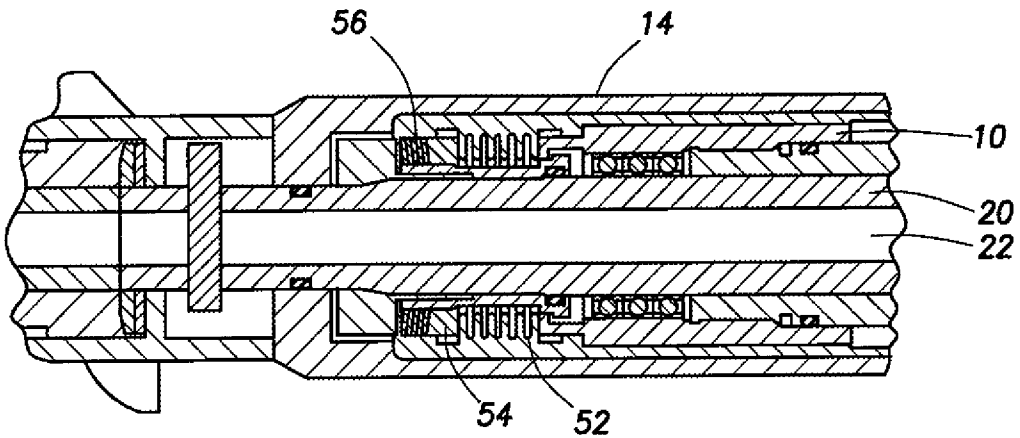
FIG. 5 shows one example of an articulated mount for a rotary face seal.

Referring to FIG. 5, in one example, the face seal in the upper bearing and seal assembly 34 may be articulated to avoid the limitations of using elastomers. In the present example, the housing face seal (non rotating) element 54 may be affixed to one end of a metal bellows 52 such as by adhesive bonding or brazing. The other end of the bellows 52 may be affixed to the housing 10. The rotating face seal element 56 may be affixed to the drive shaft 20 or a suitable device affixed to the drive shaft 20. By including the bellows 52 it is possible to sustain some axial misalignment between the rotating face seal element 56 and the fixed face seal element 54 caused by bending of the drive shaft 20 while avoiding fretting and extrusion damage that may occur to an elastomer articulation element for the face seal. The face seal may endure longer operating time without failure using the articulation device shown in FIG. 5.

Examples of a wellbore instrument according to the various aspects of the invention may have better face seal performance, reduced possibility of mud intrusion and longer seal life because of the improved pressure compensation and seal articulation described herein.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A pressure compensation system for a wellbore instrument coupled to a drill string, the instrument including a shaft rotatably mounted with respect to an instrument housing, the system comprising:

a lubrication chamber disposed in an annular space between the housing and the shaft, the lubrication chamber including therein at least one bearing for rotatably supporting the shaft, the lubrication chamber including a face seal coupled on one face to the shaft and on another face to the housing;

a pressure compensator in hydraulic communication between the lubrication chamber and the interior of the drill string, the compensator including a barrier to fluid movement between the lubrication chamber and the interior of the drill string, the barrier enabling pressure communication therebetween, the compensator including a pressure communication port extending between the barrier and a portion of the shaft exposed to the interior of the drill string, wherein the pressure compensator comprises a removable enclosure configured around the shaft and configured to be removed from around the shaft when the shaft is disassembled from the housing such that access to the removable enclosure is obtained without removing the shaft from the housing, the removable enclosure having a bladder; and a valve disposed in an interior passage of the shaft, wherein the valve closes upon removal of an upper portion of the shaft.

2. The system of claim 1 wherein the barrier comprises a piston slidably mounted in a chamber, the chamber disposed in at least one of the housing and the drill string.

3. The system of claim 1 wherein one end of the pressure communication port is open to the interior of the drill string in an uppermost portion of the shaft.

4. The system of claim 1 wherein one end of the pressure communication port is open to the interior of the drill string proximate the face seal.

5. The system of claim 1 wherein one end of the pressure compensation port is open to a mud chamber disposed inside the instrument housing.

6. The system of claim 5 further comprising a first bellows at least partially filled with liquid and disposed in the mud chamber, the first bellows configured to have a crush pressure at least as high as a maximum expected mud pressure inside the drill string.

7. The system of claim 1 wherein an uppermost end of the shaft includes a feature configured to engage with a mating feature on a recovery instrument for retrieving the wellbore instrument from the interior of the drill string.

8. The system of claim 1 wherein the bladder has hydraulic fluid therein and is in fluid communication with the lubrication chamber, wherein the pressure compensation port is in pressure communication with an exterior of the bladder.

9. The system of claim 8 further comprising an hydraulic recharge reservoir disposed in the instrument housing, the hydraulic recharge reservoir in fluid communication with the lubrication chamber and maintained at a selected pressure above a hydrostatic pressure in the wellbore, wherein momentary reduction in fluid pressure in the wellbore enables transfer of fluid in the recharge reservoir to the lubrication chamber to compensate for lubrication chamber fluid loss across the face seal during operation thereof.

10. The system of claim 9 further comprising a valve disposed in an outlet of the recharge reservoir, the valve actuatable to close the outlet when a portion of the shaft is removed from the wellbore instrument.

11. The system of claim 1 wherein a rotor of a mud flow modulation telemetry device is coupled to the shaft and a stator thereof is coupled to the housing.

12. The system of claim 1 further comprising one or more bellows comprised of metal disposed between the housing face of the face seal and the housing.

13. A wellbore instrument, comprising:

a housing configured to be coupled to a drill string;

a shaft rotatably mounted with respect to the housing;

a lubrication chamber disposed in an annular space between the shaft and the housing;

a pressure compensator in hydraulic communication with an interior of the drill string and the lubrication chamber, the pressure compensator configured to maintain a fluid pressure in the lubrication chamber at a fluid pressure inside the drill string proximate the instrument;

a face seal configured to seal a space between the shaft and the housing, one face of the face seal coupled to the shaft, another face of the face seal functionally coupled to the housing, at least one of the housing face and the shaft face including a metal bellows coupled between the respective one of the housing face and the housing and the shaft face and the shaft, wherein the pressure compensator includes a pressure communication port, and wherein the pressure compensator comprises a removable enclosure configured to be removed from around the shaft when the shaft is disassembled from the housing such that access to the removable enclosure is obtained without removing the shaft from the housing, the removable enclosure having a bladder; and a valve disposed in an interior passage of the shaft, wherein the valve closes upon removal of an upper portion of the shaft.

14. The instrument of claim 13 wherein pressure compensator includes a piston slidably mounted in a chamber, the chamber disposed in at least one of the housing and the drill string.

15. The instrument of claim 13 wherein one end of the pressure communication port is open to the interior of the drill string in an uppermost portion of the shaft.

16. The instrument of claim 13 wherein one end of the pressure compensation port is open to a mud chamber disposed inside the instrument housing.

17. The system of claim 16 further comprising a bellows at least partially filled with liquid and disposed in the mud chamber, the bellows configured to have a crush pressure at least as high as a maximum expected mud pressure inside the drill string.

18. The system of claim 13 wherein one end of the pressure compensation port is open to the interior of the drill string proximate the face seal.

19. The instrument of claim 13 wherein an uppermost end of the shaft includes a feature configured to engage with a mating feature on a recovery instrument for retrieving the wellbore instrument from the interior of the drill string.

20. The instrument of claim 13 wherein the bladder has hydraulic fluid therein and is in fluid communication with the lubrication chamber, wherein the pressure compensation port is in pressure communication with an exterior of the bladder.

21. The instrument of claim 20 further comprising an hydraulic recharge reservoir disposed in the instrument housing, the hydraulic recharge reservoir in fluid communication with the lubrication chamber and maintained at a selected pressure above a hydrostatic pressure in the wellbore, wherein momentary reduction in fluid pressure in the wellbore enables transfer of fluid in the recharge reservoir to the lubrication chamber to compensate for lubrication chamber fluid loss across the face seal during operation thereof.

22. The instrument of claim 21 further comprising a valve disposed in an outlet of the recharge reservoir, the valve actuatable to close the outlet when a portion of the shaft is removed from the wellbore instrument.

23. The instrument of claim 13 wherein a rotor of a mud flow modulation telemetry device is coupled to the shaft and a stator thereof is coupled to the housing.

* * * * *